US009838778B2

(12) United States Patent
Liu et al.

(10) Patent No.: US 9,838,778 B2
(45) Date of Patent: Dec. 5, 2017

(54) SPEAKER AND ELECTRONIC DEVICE HAVING THE SPEAKER

(71) Applicant: Acer Inc., New Taipei (TW)

(72) Inventors: Feng-Ming Liu, New Taipei (TW); Jia-Ren Chang, New Taipei (TW)

(73) Assignee: Acer Inc., New Taipei (TW)

( * ) Notice: Subject to any disclaimer, the term of this patent is extended or adjusted under 35 U.S.C. 154(b) by 0 days.

(21) Appl. No.: 14/933,037

(22) Filed: Nov. 5, 2015

(65) Prior Publication Data

US 2017/0041705 A1 Feb. 9, 2017

(30) Foreign Application Priority Data

Aug. 6, 2015 (TW) ..... 104125583 A
Aug. 6, 2015 (TW) ..... 104125647 A

(51) Int. Cl.
*H04R 1/02* (2006.01)
*H04R 1/34* (2006.01)
*H04R 1/28* (2006.01)

(52) U.S. Cl.
CPC ..... *H04R 1/345* (2013.01); *H04R 1/2811* (2013.01); *H04R 1/2815* (2013.01); *H04R 1/2819* (2013.01); *H04R 1/2892* (2013.01); *H04R 2499/15* (2013.01)

(58) Field of Classification Search
CPC .. H04R 1/2811; H04R 1/2819; H04R 1/2815; H04R 1/2823; H04R 1/345; H04R 2499/15
USPC ..... 381/162, 332, 333, 335, 349
See application file for complete search history.

(56) References Cited

U.S. PATENT DOCUMENTS 5,790,679 A * 8/1998 Hawker ..... H04M 1/0202 379/388.02
6,621,910 B1 * 9/2003 Weckstrom ..... H04M 1/03 381/346
6,631,191 B1 10/2003 Holmberg
6,758,303 B2 * 7/2004 Zurek ..... H04M 1/035 181/155
6,788,798 B1 9/2004 Backman
9,232,298 B2 1/2016 Yeh
2004/0017919 A1 1/2004 Miyakura
2004/0084244 A1 * 5/2004 Zurek ..... H04M 1/035 181/156
2008/0149417 A1 * 6/2008 Dinh ..... H04M 1/03 181/145
2009/0169041 A1 * 7/2009 Zurek ..... H04M 1/035 381/345

(Continued)

FOREIGN PATENT DOCUMENTS

CN 202617347 U 12/2012

*Primary Examiner* — William A Jerez Lora
(74) *Attorney, Agent, or Firm* — Alan D. Kamrath; Kamrath IP Lawfirm, P.A.

(57) ABSTRACT

An electronic device has a speaker. The speaker has a main body and a cover. The main body has a speaker body and a tube. The tube is situated at a side of the speaker body. The cover is situated above the main body for covering the tube and part of the speaker body, such that the speaker has a covered portion and an uncovered portion. The cover has a hole. The sound produced by the covered portion is output via the tube along a first direction. The sound produced by the uncovered portion is output via the hole along a second direction.

16 Claims, 11 Drawing Sheets

(56) References Cited

U.S. PATENT DOCUMENTS

2015/0163574 A1* 6/2015 Hamadate ..... H04N 5/642
381/388

* cited by examiner

SPEAKER AND ELECTRONIC DEVICE HAVING THE SPEAKER

BACKGROUND OF THE INVENTION

1. Field of the Invention

The present invention relates to a speaker, more particularly, to a speaker with a cover for diverting the sound from the drive unit such that the sound is transmitted in different directions, and, specifically, to an electronic device equipped with the speaker.

2. Description of the Related Art

Recently, with rapid developments in technology, portable electronic devices such as tablet computers, smart phones and laptops are designed to be compact and thin to allow users to carry them easily and enjoy the functions provided by the devices. Due to the trend of compact and thin designs, the size of the speakers installed in the above-mentioned devices has to be reduced accordingly in order to comply with the sizes of the above-mentioned devices. Thus, the sound output of the speaker is confined to a certain direction, and users usually have to sit in front of the above-mentioned device to fully enjoy the sound from the speaker. This situation causes a burden to users. Therefore, an improvement is needed.

SUMMARY OF THE INVENTION

It is an object of the present invention to provide a speaker with a cover for diverting the sound from the drive unit, such that the sound is transmitted in different directions, and to provide an electronic device equipped with the speaker.

To achieve the abovementioned object, the speaker of the present invention comprises a main body and a cover. The main body comprises a drive unit and a tube. The tube is situated at a side of the drive unit. The cover is situated above the main body for covering the tube and a portion of the drive unit, such that the drive unit has a covered portion and an uncovered portion. The cover comprises a hole. The sound from the covered portion is output via the tube along a first direction. The sound from the uncovered portion is output via the hole along a second direction.

The present invention further provides an electronic device comprising at least one of the above-mentioned speaker. Due to the design of the present invention, the directivity and the volume of the sound generated by the speaker of the present invention are increased.

DETAILED DESCRIPTION OF THE PREFERRED EMBODIMENTS

Figure 1:
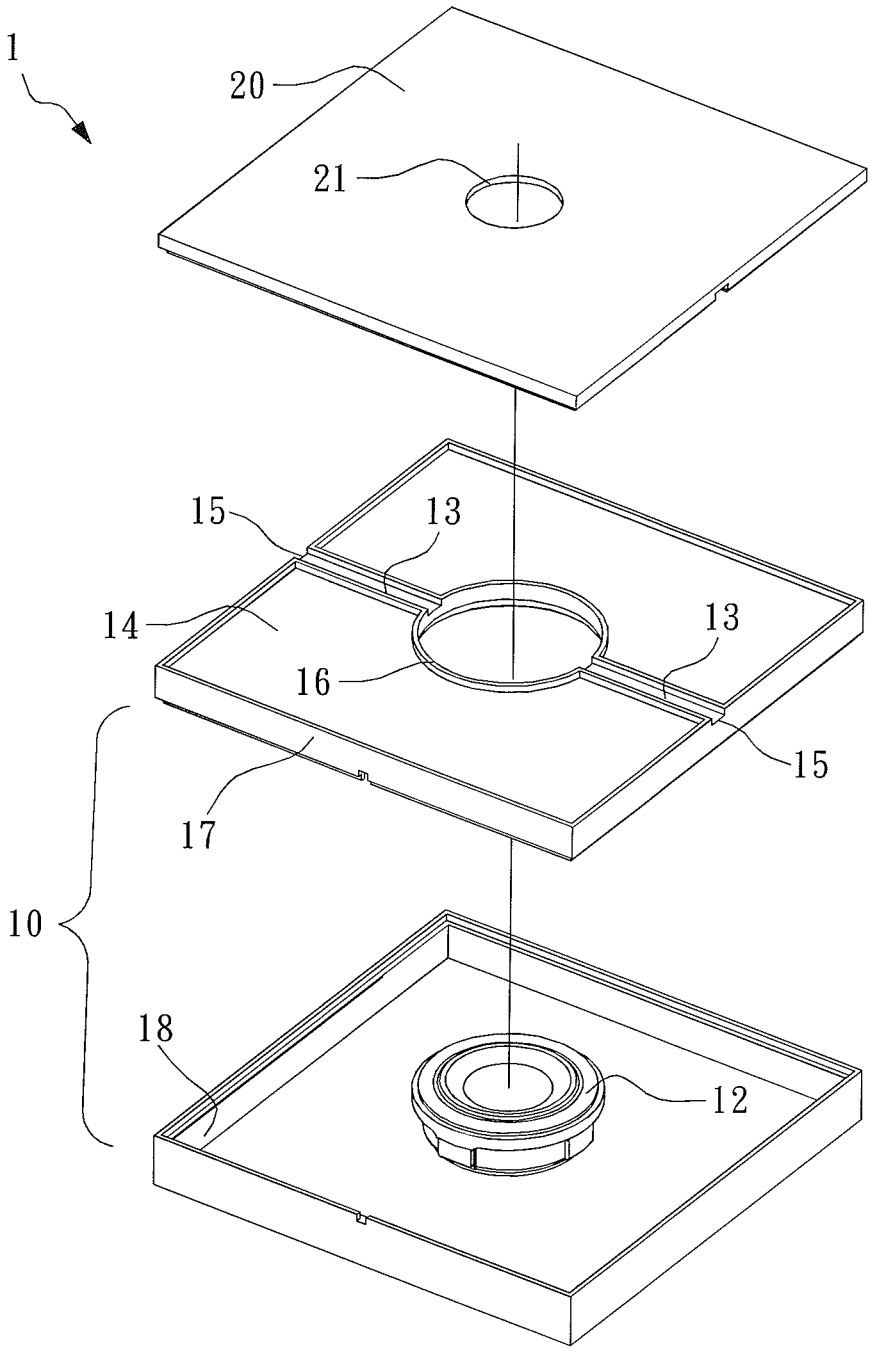
FIG. 1 is an exploded view diagram of the first embodiment of the speaker.
Figure 2:
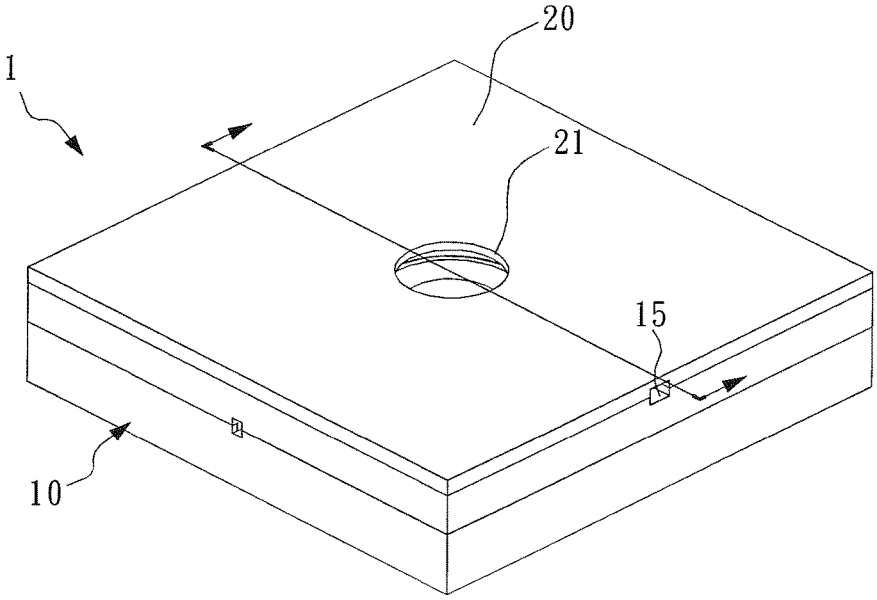
FIG. 2 is a schematic drawing of the first embodiment of the speaker.

The technical aspects of the invention will become more apparent from the following detailed description of several preferred embodiments. Please refer to FIG. 1 to FIG. 4, which present an exploded view diagram, a schematic drawing, a cross-sectional drawing, and a top-view drawing of the first embodiment of the speaker. The speaker 1 of the present invention can be installed on an electronic device such as a laptop, a tablet computer, or a liquid-crystal display. As shown in FIG. 1 and FIG. 2, in the first embodiment, the speaker 1 comprises a main body 10 and a cover 20. The cover 20 covers and is situated above the main body 10.

As shown in FIG. 1 and FIG. 2, the main body 10 comprises a drive unit 12, two tubes 13, an upper surface 14, two first sound holes 15, an opening 16, a plate 17 and a base 18. The drive unit 12 of the present embodiment can be in a horn or conical shape. Therefore, when the drive unit 12 is operating, the sound generated by the drive unit 12 is uniformly transmitted outward. The sound output surface of the drive unit 12 is circular, and the material of the membrane of the drive unit 12 can be paper, aluminum, or PET. However, the present invention is not limited to the above-mentioned embodiments. According to the design requirements of the drive unit of the speaker 1, which is the loudspeaker of the present embodiment, the sound output surface of the drive unit 12 can also be rectangular in shape.

Figure 3:
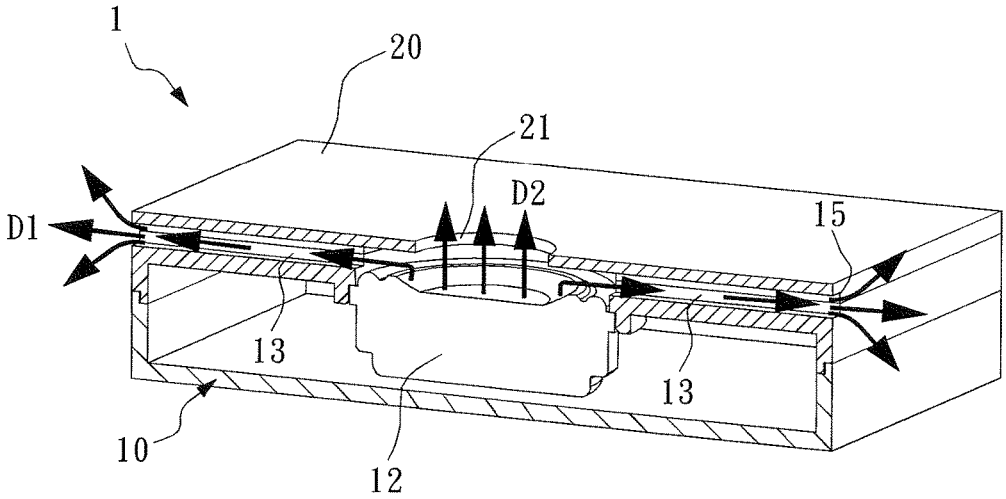
FIG. 3 is a cross-sectional drawing of the first embodiment of the speaker.

As shown in FIG. 1, the drive unit 12 is accommodated in an accommodating spaced formed by the base 18. The plate 17 covers and is situated above the base 18. In the present embodiment, the upper surface 14 is a surface close to the plate 17. As shown in FIG. 1 and FIG. 3, the drive unit 12 passes through the opening 16, which is roughly at the same vertical level as the upper surface 14. Two tubes 13 are situated on the upper surface 14. The two tubes 13 communicate with the drive unit 12 and are situated at the opposite sides of the drive unit 12. Two first sound holes 15 are individually situated at the ends of the two tubes 13 that are away from the drive unit 12. It is noted that the quantity of the tubes 13 can be single or a plurality and that the tubes 13 can be disposed around the drive unit 12. The quantity of the first sound holes 15 is equal to the quantity of the tubes 13.

Figure 4:
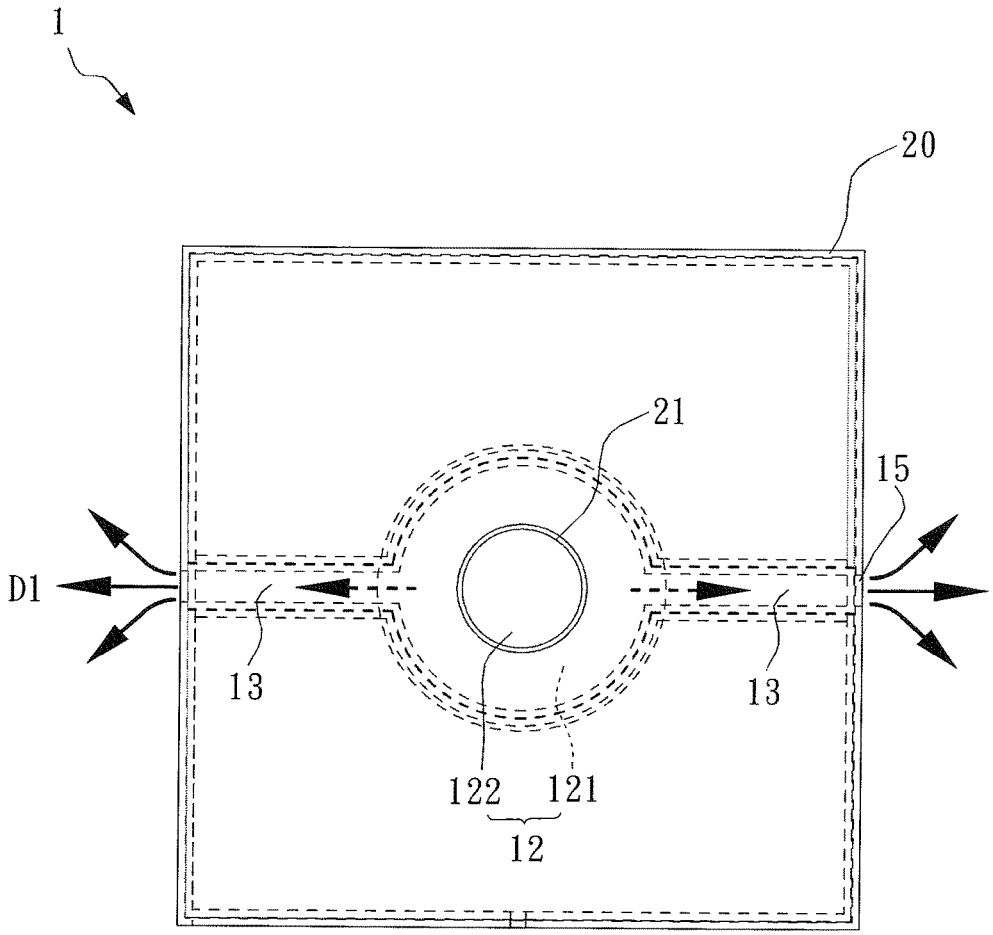
FIG. 4 is a top-view drawing of the first embodiment of the speaker.

As shown in FIG. 1 and FIG. 4, the cover 20 comprises a hole 21. In the present embodiment, the shape of the hole 21 is circular and matches the sound output surface of the drive unit 12. However, the present invention is not limited to this embodiment. The cover 20 is situated above the upper surface 14, such that it covers the two tubes 13 and a portion of the drive unit 12, thereby forming a Helmholtz resonant cavity between the cover 20 and the two tubes 13. Meanwhile, because of the hole 21 of the cover 20, the drive unit 12 has a covered portion 121 and an uncovered portion 122.

The hole 21 overlaps with the uncovered portion 122. As shown in FIG. 1, in the present embodiment, the center axis of the hole 21 of the cover 20 overlaps with the center axis of the drive unit 12. In other words, as shown in FIG. 4, the covered portion 121 and the uncovered portion 122 are covered by the drive unit 12 in a concentric circular alignment; i.e., the covered portion 121 is situated around the surrounding of the uncovered portion 122, and the uncovered portion 122 is situated at the center of the drive unit 12. It is noted that the present invention is not limited to this embodiment. The relative positions of the covered portion 121 and the uncovered portion 122 may remain unchanged even when the drive unit 12 is rectangular in shape.

It is noted that, as shown in FIG. 3, when the drive unit 12 operates, the sound waves generated by the drive unit 12 are diverted along two different expansion paths due to the cover 20. The sound waves from the uncovered portion 122 overlapping with the hole 21 are output via the hole 21. The sound waves from the portion covered by the cover 20 are output via the tube 13 through the first sound hole 15 due to the Helmholtz resonant theory. In other words, as shown in FIG. 3 and FIG. 4, the sound output by the drive unit 12 can be diverted along two directions by the cover 20; i.e., the sound from the covered portion 121 is output first through the first sound hole 15 along a first direction D1 via the tube 13 to create a new direction of movement for the sound output by the drive unit 12. The sound from the uncovered portion 122 is output directly via the hole 21 along a second direction D2. Therefore, in addition to the original sound output direction (the second direction D2), a second direction (along tube 13) is provide by the speaker 1 due to the Helmholtz resonant theory, such that the directivity and the volume of the sound generated by the speaker 1 are increased.

It is noted that the area of the hole 21 (the area of the uncovered portion 122) ranges from 30% and 60% of the original sound output area of the drive unit 12. In order to ensure the quality of the high frequency output and the quantity of the sound from the original output direction of the drive unit 12, a preferred range of the area of the hole 21 (the area of the uncovered portion 122) is between ½ to ⅓ of the original sound output area of drive unit 12. Furthermore, in the present embodiment, the first direction D1 is perpendicular to the original output direction of the drive unit 12.

Figure 5:
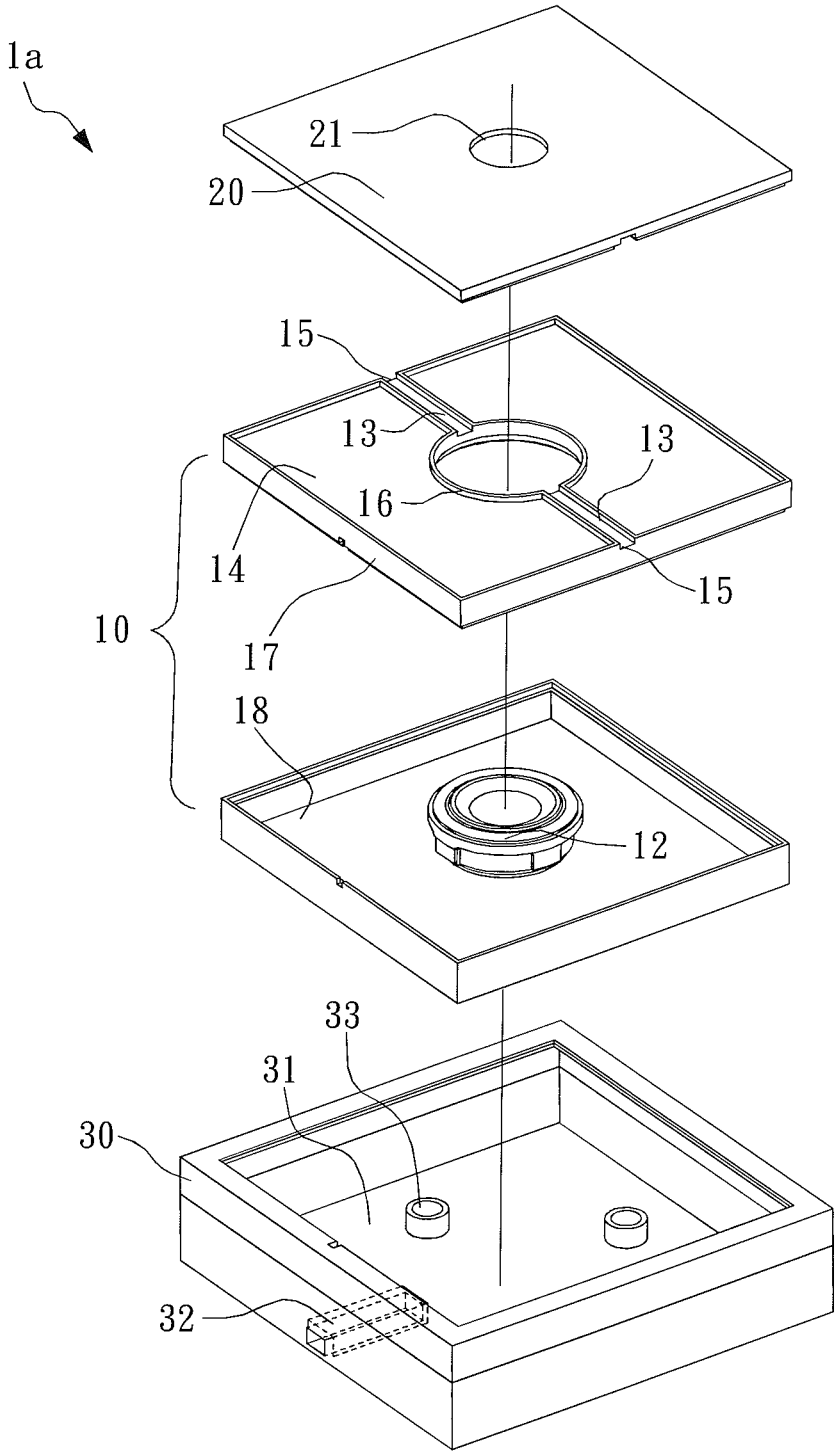
FIG. 5 is an exploded view diagram of the second embodiment of the speaker.
Figure 6:
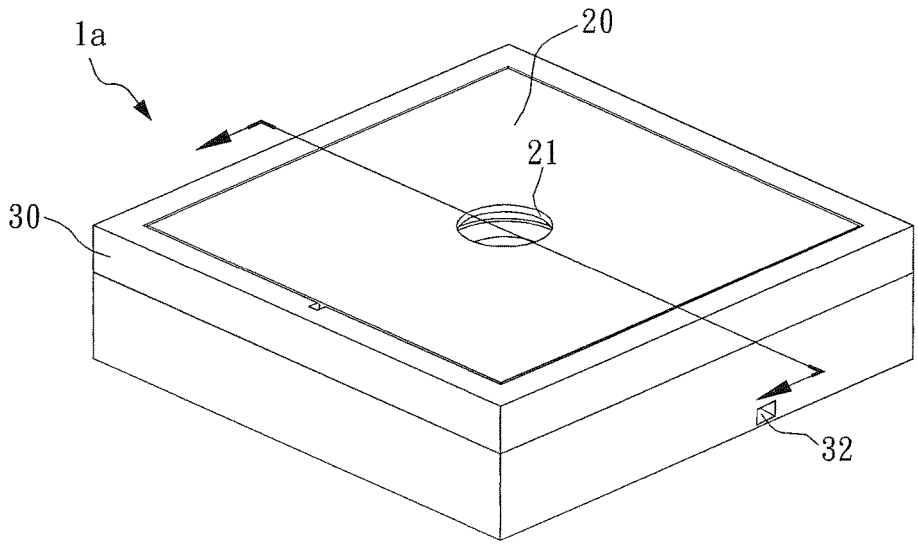
FIG. 6 is a schematic drawing of the second embodiment of the speaker.
Figure 7:
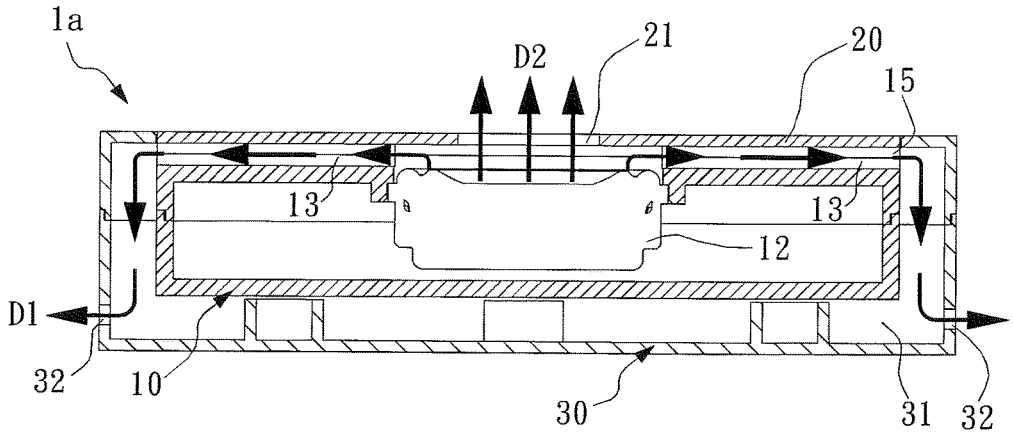
FIG. 7 is a cross-sectional drawing of the second embodiment of the speaker.

Please refer to FIG. 5 to FIG. 7, which present an exploded view diagram, a schematic drawing and a cross-sectional drawing of a second embodiment of the speaker.

As shown in FIG. 5 to FIG. 7, in the second embodiment, the speaker 1*a* comprises a main body 10, a cover 20 and a bass reflex box 30. The structure and the relative positions of the main body 10 and the cover 20 of the second embodiment are the same as those disclosed in the first embodiment. For brevity, the detailed descriptions are omitted, but please refer to the related disclosure in the first embodiment. The bass reflex box 30 comprises a cavity 31, two second sound holes 32 and a bump 33. In the second embodiment, the main body 10 is a closed front cavity of the speaker 1*a*. The main body 10 is disposed in the bass reflex box 30 and is situated on the bump 33. The cavity 31 of the bass reflex box 30 communicates with the two tubes 13 of the main body 10. The two second sound holes 32 are individually situated at the two opposite sides of the bass reflex box 30.

As shown in FIG. 7, due to the design of the cover 20 and the tube 13, when the drive unit 12 operates, the sound waves from the uncovered portion 122 overlapping with the hole 21 are output via the hole 21. The sound waves from the portion covered by the cover 20 are transmitted via the tube 13, enter the cavity 31, and then are output via the second sound hole 32 along the first direction D1. As a result, the low frequencies that are output by the speaker 1*a* can be extended, abnormal sound is prevented, and tolerated power is increased.

Figure 8:
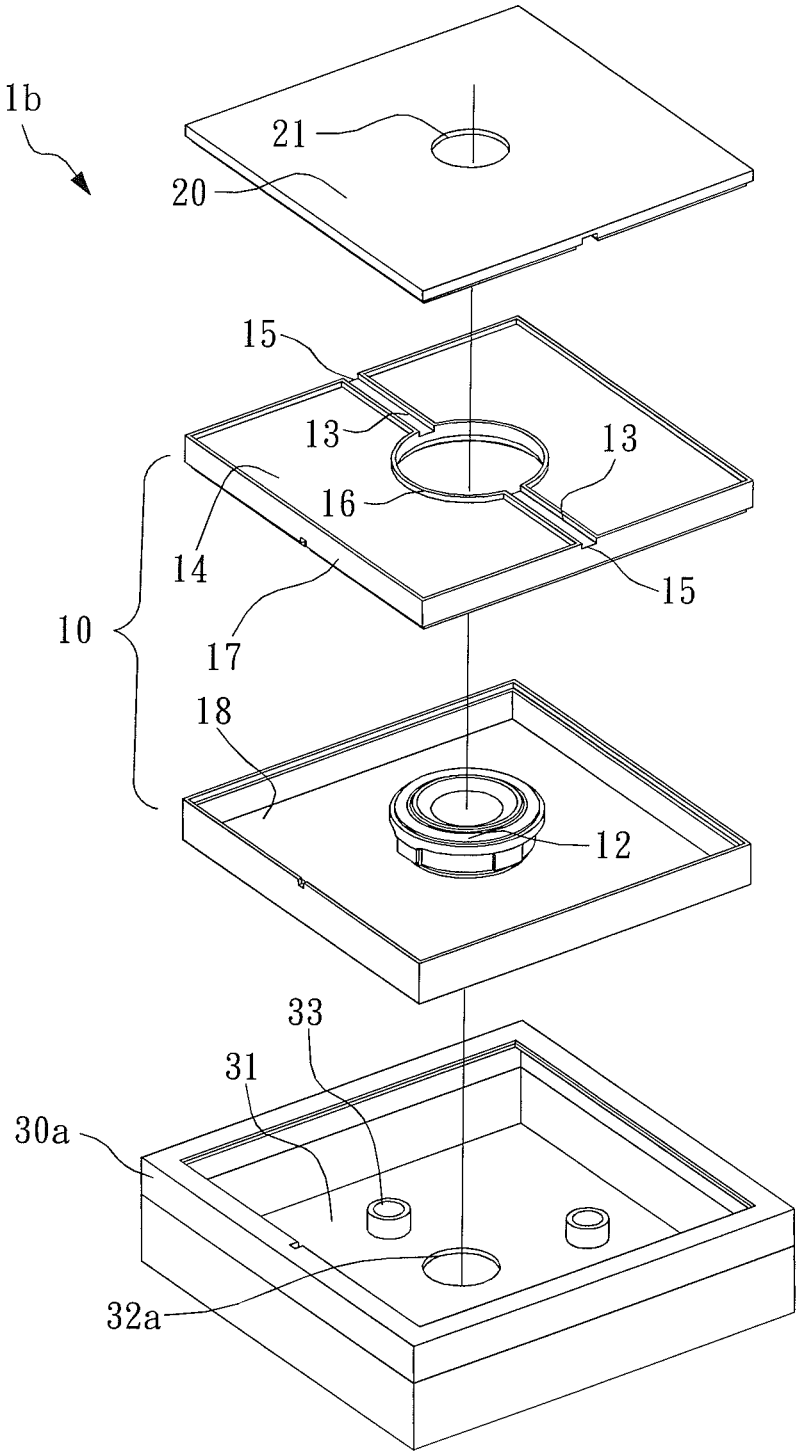
FIG. 8 is a cross-sectional drawing of the third embodiment of the speaker.
Figure 9:
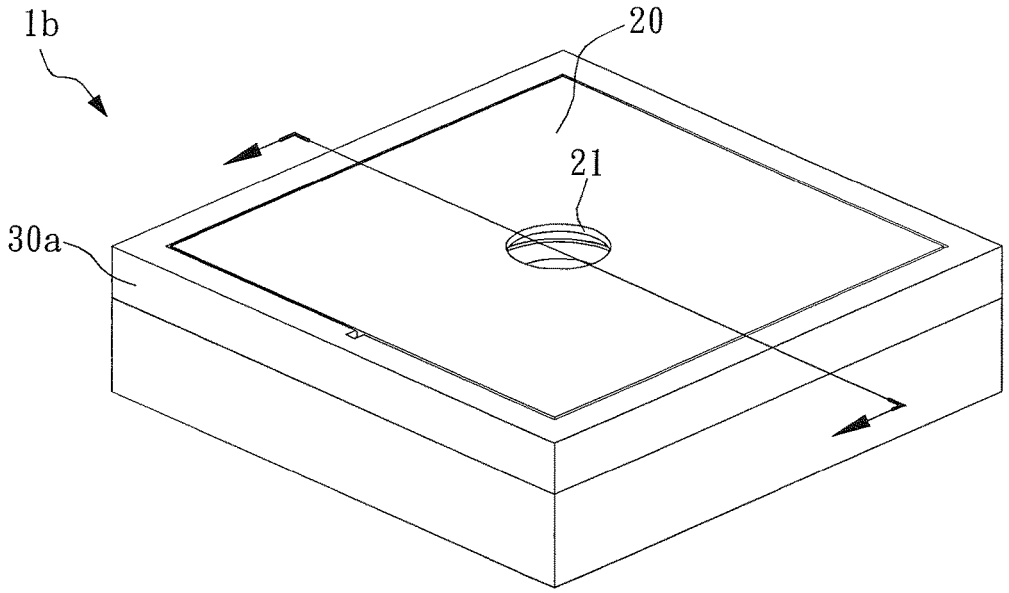
FIG. 9 is a schematic drawing of the third embodiment of the speaker.
Figure 10:
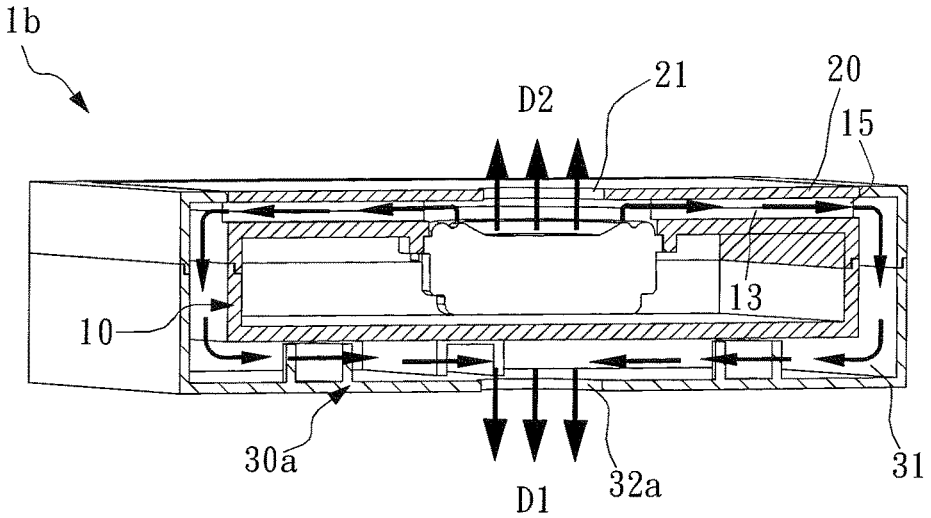
FIG. 10 is a cross-sectional drawing of the third embodiment of the speaker.

Please refer to FIG. 8 to FIG. 10, which present an exploded view diagram, a schematic drawing, and a cross-sectional drawing of the third embodiment.

As shown in FIG. 8 and FIG. 10, in the third embodiment, the speaker 1*b* comprises a main body 10, a cover 20 and a bass reflex box 30*a*. The structure and the relative positions of the main body 10 and the cover 20 of the third embodiment are same as those disclosed in the first embodiment. For brevity, the detailed descriptions are omitted, but please refer to the related disclosure in the first embodiment. The most distinguishing difference between the bass reflex box 30*a* and the above-mentioned bass reflex box 30 is the location of the second sound hole 32*a*. In the present embodiment, there is only one second sound hole 32*a*, and the one second sound hole 32*a* is situated at the bottom of the bass reflex box 30*a*. It is noted that the number of the second sound holes 32, 32*a* can be either one or two, and the invention is not limited by the disposition of the second sound holes 32, 32*a* in the bass reflex box 30 or 30*a*.

As shown in FIG. 10, when the drive unit 12 operates, the sound waves from the uncovered portion 122 overlapping with the hole 21 are output via the hole 21. The sound waves from the portion covered by the cover 20 are transmitted via the tube 13, enter the cavity 31, and then are output via the second sound hole 32 situated at the bottom of the bass reflex box 30*a* along the first direction D1 due to the Helmholtz resonant theory. It is noted that, because the second sound hole 32*a* is situated at the bottom of the bass reflex box 30*a*, the first direction D1 is parallel to the second direction D2 but faces in the opposite direction. Due to the additional output along the first direction D1 of the bass reflex box 30*a*, the low frequencies output by the speaker 1*a* can be extended to prevent sound distortion and increase the amplitude.

Figure 11:
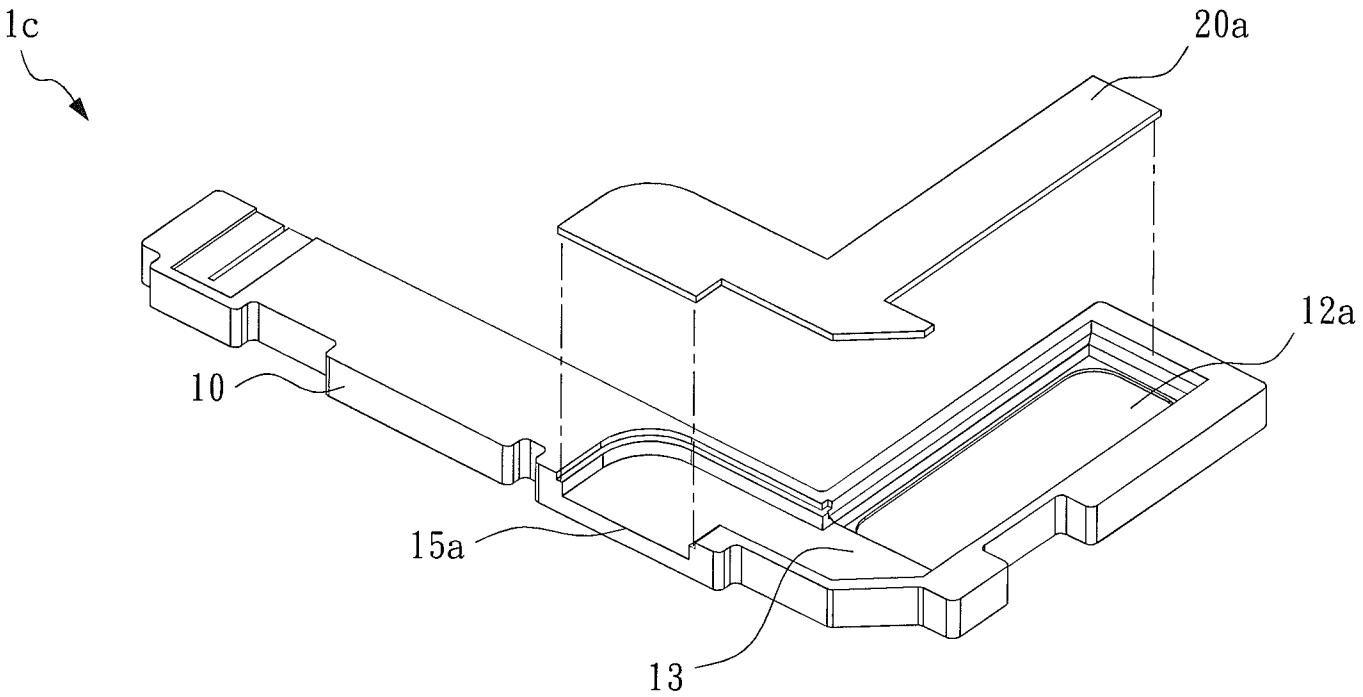
FIG. 11 is an exploded view diagram of the fourth embodiment of the speaker.
Figure 14:
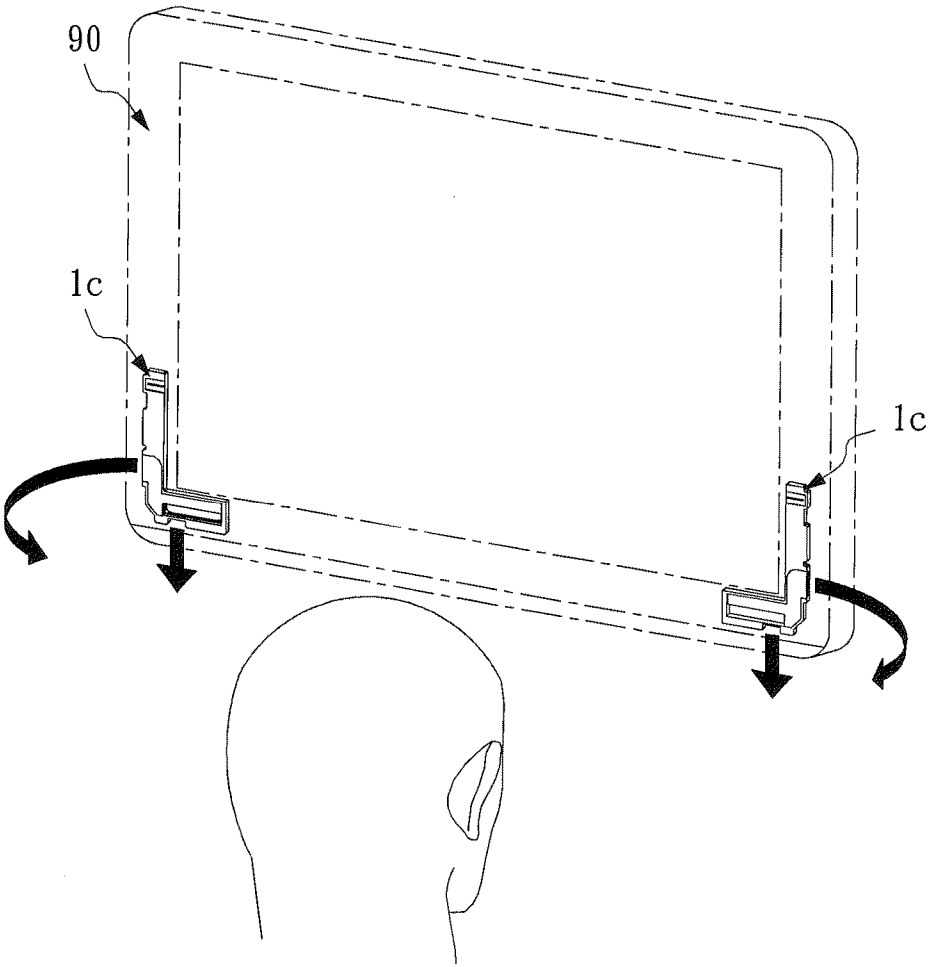
FIG. 14 is a schematic drawing of the environment according to the fourth embodiment of the speaker.

Please refer to FIG. 11 and FIG. 14, which present an exploded view diagram, a schematic drawing and a cross-sectional drawing of the fourth embodiment of the speaker.

Figure 12:
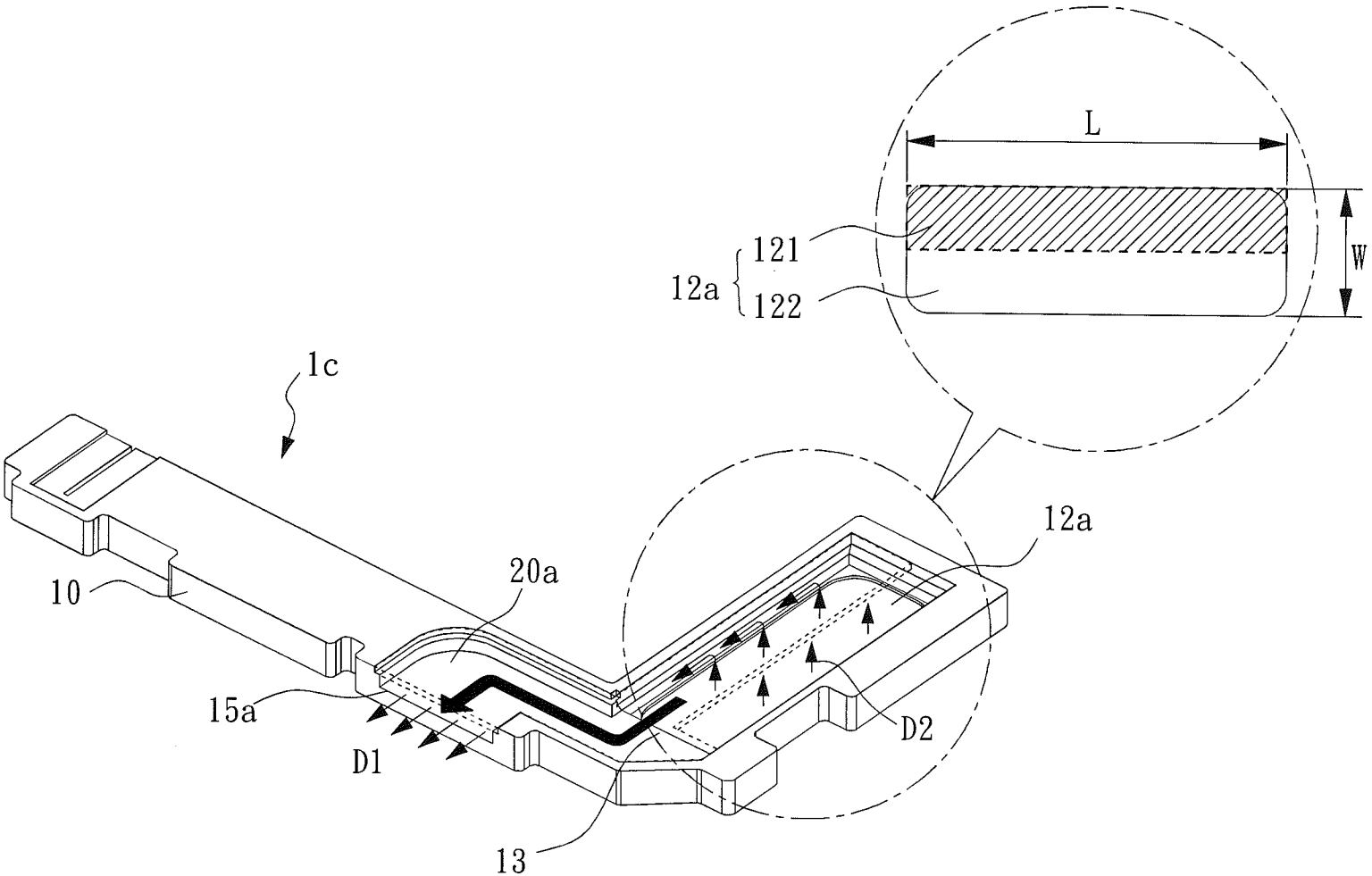
FIG. 12 is a schematic drawing illustrating the operation of the fourth embodiment of the speaker.

As shown in FIG. 11 and FIG. 12, in the present embodiment, the speaker 1*c* is a micro-speaker and comprises a main body 10 and a cover 20*a*. The cover 20*a* is situated above the main body 10. The main body 10 comprises a drive unit 12*a*, a tube 13 and a sound hole 15*a*. The drive unit 12*a* of the present embodiment is a planar type drive unit having a length L and a width W. Specifically, when the drive unit 12*a* operates, the sound generated by the drive unit 12*a* is output along a single direction only. In other words, the sound is output along a direction perpendicular to the sound output surface of the drive unit 12*a*. The sound output surface of the drive unit 12*a* is rectangular in shape, and the material of the membrane of the drive unit 12*a* is plastic.

In the present embodiment, the quantity of the tube 13 is one, and the tube 13 is disposed along the short axis of the drive unit 12*a*. The sound hole 15*a* is situated at the end of the tube 13 that is away from the drive unit 12*a*. As shown in FIG. 11 and FIG. 12, the cover 20*a* covers the tube 13 and a portion of the drive unit 12*a*, such that the drive unit 12*a* has a covered portion 121 and an uncovered portion 122. By this design, a Helmholtz resonant cavity is formed between the cover 20*a* and the tubes 13. The sound from the covered portion 121 is output via the tube 13 and the sound hole 15*a* along the first direction D1. The sound from the uncovered portion 122 is output along the second direction D2. Due to the design of the cover 20*a*, when the drive unit 12*a* operates, the sound waves generated by the drive unit 12*a* are diverted along two different expansion paths. The sound waves from the uncovered portion 122 are still output along the original sound output direction (the second direction D2). The sound waves from the covered portion 121 are output via the tube 13 through the sound hole 15*a* along a first direction D1 due to the Helmholtz resonant theory. Thus, a new direction of movement of the sound of the speaker 1*c* is created to divert the sound of the speaker 1*c*, such that it is output along its original sound output direction (the second direction D2) and along the first direction D1 for increasing the directivity and the volume of the speaker 1*c*.

As shown in FIG. 12, because the drive unit 12*a* is rectangular in shape, the sound generated by the drive unit 12*a* is output along a single direction. According to a preferred embodiment of the present invention, in order to ensure the extension of the sound from the speaker 1*c*, the drive unit 12*a* must be covered along a direction parallel to the long axis of the drive unit 12*a* by the cover 20*a* to prevent the sound waves generated by the drive unit 12*a* from interfering with each other and thereby reducing the output quality of the speaker 1*c*. Furthermore, the area of the covered portion 121 ranges from 10% to 60% of the original sound output area of the drive unit 12*a*. In order to ensure the quality of the high frequency output and the quantity of the sound from the original output direction of the drive unit 12*a*, a preferred range of the covered portion 121 is from ½ to ⅓ of the original sound output area of the drive unit 12*a*. Furthermore, in the present embodiment, the first direction D1 is perpendicular to the original output direction of the drive unit 12*a* (second direction D2).

Figure 13:
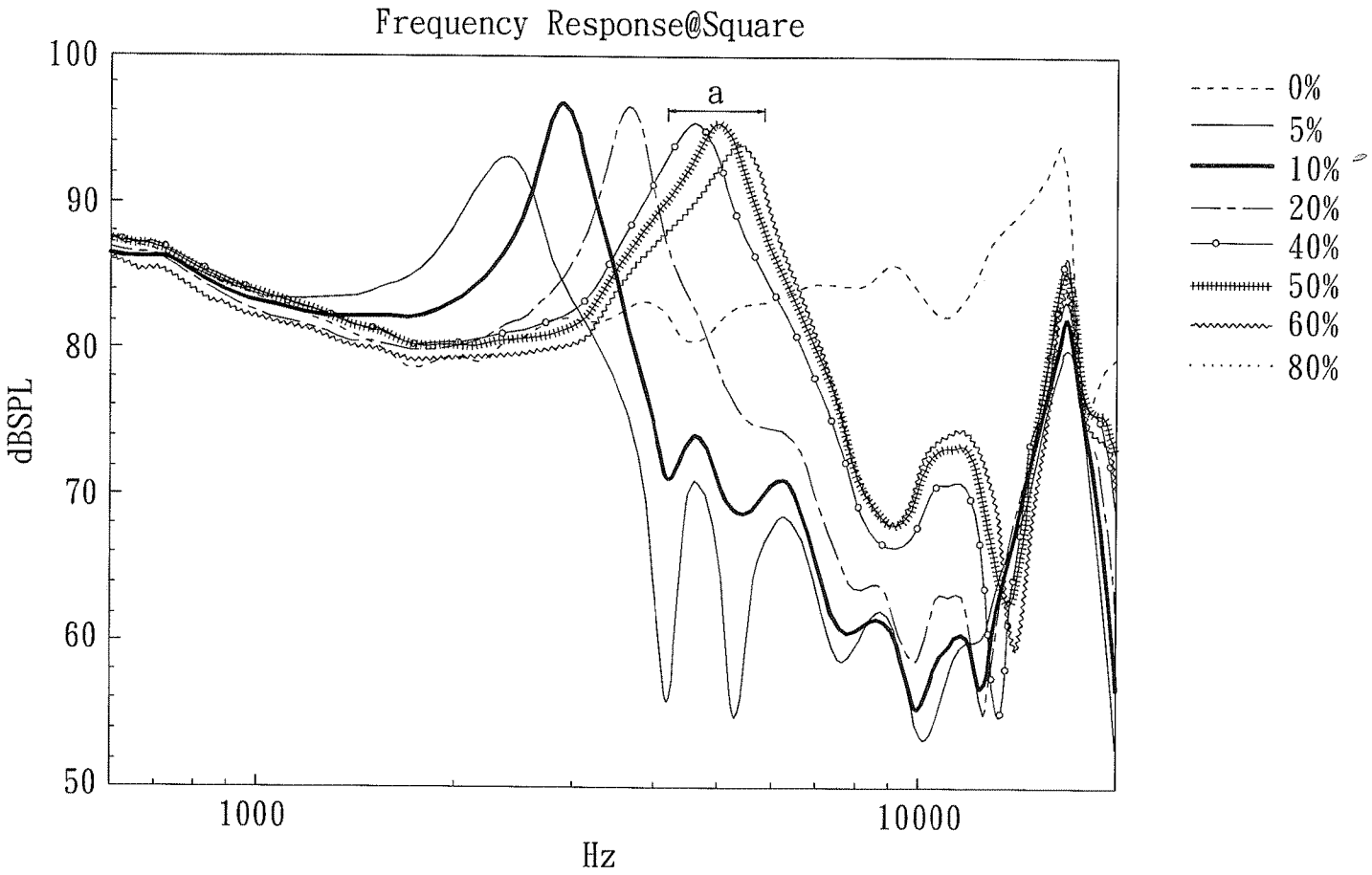
FIG. 13 illustrates the frequency response curves of the fourth embodiment of the speaker.

FIG. 13 illustrates the changes in the frequencies of the various percentages of the covered portion 121 which occupies the sound output area of the drive unit 12 of the speaker 1*c*. As shown in FIG. 13, the change in the percentages of the covered portion 121 occupying the sound output area of the drive unit 12 extends the low frequencies of the speaker 1*c*. It is also indicated in FIG. 13 that when 40% to 60% (region a) of the drive unit 12 is covered, the speaker 1*c* outputs the sound with relatively better quality, around 7,000 Hz. As shown in FIG. 14, the speaker 1*c* can be installed on an electronic device 90 such as a laptop, a tablet computer, or a display. The number of speakers 1*c* thus installed can be one or a plurality. Furthermore, with the design of the cover 20, the sound of the speaker 1*c* can be output both at the lateral side and in front of the user, and the directivity and the volume of the sound output by the speaker 1*c* can thereby be increased accordingly.

As described above, the objectives, means, and effectiveness of the present invention differ from the characteristics of the prior art. It should be noted that the embodiments described above are for illustrating the principles and effects of the present invention and not for limiting the scope of the present invention. Any person skilled in the art should be able to make modifications and changes to the embodiments without departing from the technical principle and spirit of the present invention. The claims of the present invention within the scope of protection are described below.

What is claimed is:

1. A speaker comprising:

a main body comprising a drive unit and a tube, wherein the tube is disposed at a side of the drive unit; and a cover extending in a first direction, abutting with the main body and covering the tube and a portion of the drive unit, with the cover including a hole aligned with the drive unit in a second direction, wherein the second direction is perpendicular to the first direction, wherein the drive unit has a covered portion misaligned with the hole in the second direction and an uncovered portion aligned with the hole in the second direction, wherein the tube covered by the cover extends in the first direction from the covered portion into the uncovered portion, wherein a sound from the covered portion is output along the first direction via the tube and the sound from the uncovered portion is output along the second direction, wherein the sound from the uncovered portion is output via the hole along the second direction, with the main body comprising a base and a plate including an upper surface opposite to the base, with the plate intermediate the cover and the base, wherein the drive unit is disposed in the base and intermediate the base and the plate, the plate covers the base, the plate includes an opening aligned with the drive unit and the hole in the second direction, and the tube is a U-shaped channel situated at the upper surface, which is in communication with the opening and extends in the first direction, with the cover covering the tube.

2. The speaker as claimed in claim 1, wherein the main body comprises a first sound hole situated at an end of the tube away from the drive unit such that the sound from the covered portion is transmitted via the tube along the first direction and then output from the first sound hole in the first direction.

3. The speaker as claimed in claim 2, wherein the drive unit is rectangular in shape and the cover covers the drive unit along the long-axis of the drive unit.

4. The speaker as claimed in claim 3, wherein the covered portion occupies 10% to 60% of a sound output area of the drive unit.

5. The speaker as claimed in claim 1, wherein the main body comprises a first sound hole situated at an end of the at least one tube away from the main body such that the sound from the covered portion is output via the tube along the first direction.

6. The speaker as claimed in claim 1, wherein the uncovered portion occupies 30% to 60% of a sound output area of the drive unit.

7. The speaker as claimed in claim 1, wherein the tube is a plurality of tubes and disposed around the drive unit.

8. The speaker as claimed in claim 1, with the speaker comprising a bass reflex box and a second sound hole, wherein the main body is disposed in the bass reflex box and a cavity is formed between the bass reflex box and the main body; and wherein the cavity communicates with the tube such that the sound from the covered portion is transmitted via the tube along the first direction and then is output via the cavity through the second sound hole.

9. The speaker as claimed in claim 8, wherein the uncovered portion occupies 30% to 60% of a sound output area of the drive unit.

10. An electronic device comprising:

a device body; and at least one speaker disposed in the device body, with the at least one speaker comprising:

a main body comprising a drive unit and a tube, wherein the tube is situated at a side of the drive unit; and a cover extending in a first direction and covering the tube and a portion of the drive unit, with the cover including a hole aligned with the drive unit in a second direction, wherein the second direction is perpendicular to the first direction, wherein the drive unit has a covered portion misaligned with the hole in the second direction and an uncovered portion aligned with the hole in the second direction, wherein the tube covered by the cover extends in the first direction from the covered portion into the uncovered portion, wherein a sound from the covered portion is output via the tube along the first direction and the sound from the uncovered portion is output along the second direction, wherein the sound from the uncovered portion is output via the hole along the second direction, with the main body comprising a base and a plate including an upper surface opposite to the base, with the plate intermediate the cover and the base, wherein the drive unit is disposed in the base and intermediate the base and the plate, the plate covers the base, the plate includes an opening aligned with the drive unit and the hole in the second direction, and the tube is a U-shaped channel situated at the upper surface, which is in communication with the opening and extends in the first direction, with the cover covering the tube.

11. The electronic device as claimed in claim 10, wherein the drive unit is rectangular in shape and the cover covers the drive unit along a long-axis of the drive unit.

12. The electronic device as claimed in claim 11, wherein the covered portion occupies 10% to 60% of a sound output area of the drive unit.

13. The electronic device as claimed in claim 10, with the speaker comprising a bass reflex box and a second sound hole, wherein the main body is disposed in the bass reflex box and a cavity is formed between the bass reflex box and the main body; and wherein the cavity communicates with the tube such that the sound from the covered portion is transmitted via the tube along the first direction and then is output via the cavity through the second sound hole.

14. The electronic device as claimed in claim 13, wherein the uncovered portion occupies 30% to 60% of a sound output area of the drive unit.

15. The electronic device as claimed in claim 10, wherein the tube is a plurality of tubes disposed around the drive unit.

16. The electronic device as claimed in claim 15, wherein the uncovered portion occupies 30% to 60% of a sound output area of the drive unit.

* * * * *